US011242574B2

(12) United States Patent
Shi et al.

(10) Patent No.: US 11,242,574 B2
(45) Date of Patent: Feb. 8, 2022

(54) PROCESS FOR PRODUCING LEATHER

(71) Applicant: BASF SE, Ludwigshafen am Rhein (DE)

(72) Inventors: Qing Shi, Shanghai (CN); Laszlo Szarvas, Hong Kong (CN); Biyu Peng, Chengdu (CN); Chunxiao Zhang, Chengdu (CN)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 16/308,854

(22) PCT Filed: Jun. 12, 2017

(86) PCT No.: PCT/EP2017/064299

§ 371 (c)(1),
(2) Date: Dec. 11, 2018

(87) PCT Pub. No.: WO2017/216111

PCT Pub. Date: Dec. 21, 2017

(65) Prior Publication Data

US 2019/0309378 A1 Oct. 10, 2019

(30) Foreign Application Priority Data

Jun. 14, 2016 (WO) ..... PCT/CN2016/085705

(51) Int. Cl.
*C14C 1/08* (2006.01)
*C14C 3/06* (2006.01)

(52) U.S. Cl.
CPC . *C14C 1/08* (2013.01); *C14C 3/06* (2013.01)

(58) Field of Classification Search
CPC ..... C14C 1/08; C14C 3/06
See application file for complete search history.

(56) References Cited

U.S. PATENT DOCUMENTS

2015/0376726 A1 12/2015 Bertkau et al.

FOREIGN PATENT DOCUMENTS

| | | | | |
|---|---|---|---|---|
| CN | 102080134 A | | 6/2011 | |
| CN | 104711383 | * | 6/2015 | ..... C14C 3/06 |
| EP | 0563139 | | 7/1992 | |
| EP | 2607499 | * | 6/2013 | ..... C14C 1/08 |
| WO | WO9211391 | * | 7/1992 | ..... C14C 1/08 |
| WO | WO 2014/124951 A1 | | 8/2014 | |

OTHER PUBLICATIONS

Chen et al. Derwent 2011-J08237, 2013.*
International Search Report dated Sep. 19, 2017, in PCT/EP2017/064299, filed Jun. 12, 2017.

* cited by examiner

*Primary Examiner* — Amina S Khan
(74) *Attorney, Agent, or Firm* — Arent Fox LLP

(57) ABSTRACT

The present invention relates to a process for producing leather in which methanesulfonic acid (MSA) is used in the pickling step at a high pH value, and the use of MSA is to improve the quality of the final leather product as well as to improve the environmental impact of the waste liquor.

9 Claims, 2 Drawing Sheets

The SEM photographs of the grain of the crust leather (×300, top) and the cut (×1000, ×5000, respectively, bottom)

PROCESS FOR PRODUCING LEATHER

TECHNICAL FIELD OF THE INVENTION

The present invention relates to a process for producing leather, especially to the pickling of hides or skins to achieve high-exhaustion of chrome in chrome tanning process.

Background of the Invention

Tanning is a technology of using a tanning agent to convert hides or skins to leathers or furs. It is one of the processes within the whole value chain. The key procedures in leather making are as follows: Raw hides or skins→Soaking→Liming→Deliming→Bating→Pickling→Basification→Tanning→Retanning→Dyeing→Fatliquoring→Finishing.

The actual tanning step takes place in the presence of a tanning agent. Suitable tanning processes comprise tanning with mineral salts (chromium(III), aluminum, zirconium or iron salts), vegetable tanning with vegetable tanning agents (tannins in leaves, bark, woods or fruit), oil tanning with fish or marine-animal oils (train oils) or with brain fats, synthetic tanning with synthetically produced tanning agents (syntans, resin type tanning agents, polymer type tanning agents, polyphosphates, or paraffin sulfochloride), and aldehyde tanning (formerly formaldehyde, now mainly glutaraldehyde). It is also possible to use various tanning processes in combination.

Among them, chrome tanning is widely used in the leather industry because of the excellent qualities of the chrome-tanned leather, such as high hydrothermal stability, good dyeing characteristics as well as softness. There is an average estimation that approximately 90% of leather products in the world are from chrome tanning.

However, chrome tanning is controversial due to the high Cr (III) content in the waste water. Only 60 to 80% of the chrome added is absorbed by the hide or skin in the conventional tanning process, and the rest is discharged into the spent tanning liquor (about 1,000-3,000 $mg \cdot L^{-1}$), resulting in serious environment pollution and waste of chrome resource. Furthermore, chrome is now being questioned for the possible conversion from Cr (III) to carcinogenic Cr (VI) under an oxidizing condition. Therefore, tanners are always trying to develop a chrome-free tanning technology. However, in general, the overall performance of chrome-free leather is not comparable with the chrome-tanned one. Thus, many researches are focusing on developing high chrome exhaustion systems in order to reduce the chrome content in the waste water.

During the chrome tanning, the main reaction takes place between the collagen, which contains amino and carboxyl groups, and the Cr (III) ions. Forming coordination bonds between Cr (III) ions (from the tanning agent) and the carboxyl groups on the side chains of the collagen is the premise of the chrome tanning technology.

During the chrome tanning, in order to achieve an evenly tanning effect, it is desired to make Cr (III) ions to penetrate into the hide and combine with the carboxyl groups therein, rather than react with the carboxyl groups on the surface of the hide, which would cause the hide to be too hard to use. On the other hand, great efforts are making to promote the reactivity between the Cr (III) ions and the carboxyl groups of the collagen and thus to improve the tanning effectiveness. In another word, the combination of Cr (III) ions with the carboxyl groups and the penetration of the Cr (III) ions is a pair of contradictions in the chrome tanning process, and tanners have to balance the competing process rates of the penetration and the reaction.

Conventionally, there are two main approaches to balance the contradictions of the penetration and the combination of the Cr (III) ions.

1) Adjusting pH of the hide by adding an acid. After the addition of an acid, $COO^-$ is blocked, the collagen is inhibited from dissociating, which otherwise will react with chromium. Moreover, the hydrogen ions would increase the cationic property of the collagen, thus promoting the tanning agent and the collagen to bind with each other on the surface,
2) The anions of the acid coordinate with the trivalent chromium ions, which is also known as "a masking effect", thus helping the tanning agent penetrate into the inner layer of the hide.

As the acid, for example, an inorganic acid could be used. However, as the inorganic acid could present various disadvantages such as the CI pollution (for HCl) or the N pollution (for $HNO_3$), it is also possible to use an organic acid, such as a monocarboxylic acid, a dicarboxylic acid, or a hydroxylcarboxylic acid. Among them, as the affinity of the formate to the chromium ion is slightly weaker than that of the carboxyl of the collagen to the chromium ion, thus formic acid is the dominant masking agent in the chrome tanning.

In fact, the addition of an organic acid in the pickling step in the conventional chrome tanning process introduces relatively large quantities of carboxylates into the tanning liquor, which may produce rather a strong masking effect on the chromium ions and a strong coordinating ability of the carboxylate groups with the chromium ions, resulting in the decrease of the possibility of the carboxyl groups of the collagen entering into the inner spheres formed by the chromium complex ions to substitute the existing organic ligands and form the stable Cr-collagen complexes, accordingly, the uptake ratio of chrome is kept at a rather low level.

Carboxylates with different molecular structures have been chosen and researched. Although these agents can increase the chromium exhaustion to certain degrees, it is difficult to achieve a chromium utilization ratio up to 85%, and the leather is often negatively affected by the application of the agents.

Therefore, the object of the present invention is to overcome the disadvantages of the prior art and to provide a process for producing leather, which could increase the uptake of Cr (III) in the chrome tanning, and decrease the Cr (III) content in the waste tanning liquor. The object is achieved by using methane sulfonic acid (hereinafter abbreviated as MSA) in the pickling of the hide or skin at a pH above or equal to 4.

The inventors surprisingly found that by using MSA in the pickling of the hide or skin at a pH above or equal to 4 before tanning with Cr (III), the uptake of Cr (III) significantly increases and the Cr (III) content in the waste tanning liquor decreases; moreover, Cr (III) ions are evenly distributed in the leather, thus an evenly-tanned leather is obtained, and the mechanical properties of the resulted leather are improved. Based on this discovery, the present invention has been completed.

The use of MSA in the treatment of hides has been disclosed in the prior art.

EP 563139 discloses a process for processing hides, in which the hides are brought into contact with MSA in the treatment, such as in the tanning or pickling. In the examples, MSA is employed in the step of pickling. It is said that when hides are contacted with MSA or methane sulfonate ions in an acidic medium, in whatever the processing stage this contacting is carried out, there has been a release effect of the fibers of the collagen tissue and an internal distribution effect of the fats: the thickness of the skin becomes more uniform, at the same time the surface area thereof significantly increases, resulting in the homogenization of the thickness, the increase of the surface area, and the improvement of the surface qualities (touch, appearance) and the flexibility of the leather. However, EP 563139 does not disclose that the use of MSA in pickling could increase the uptake of Cr (III) in the tanning and decrease the Cr (III) content in the waste tanning liquor, and make Cr (III) ions to evenly distribute in the hides and improve the mechanical properties of the resulted leather. In fact, EP 563139 does not disclose the pH in the pickling solution. It is measured that the general range of pH in EP 563139 is from about 0.5 to about 1.7, while the pickling pH in the example is about 2.5. Moreover, formic acid is used in the example of EP 563139.

WO 2014/124951 A1 discloses a process for producing leather comprising a plurality of steps, wherein MSA is used in at least one step selected from deliming, bating, pickling, tanning, retanning, dyeing, and fatliquoring. It is said that the use of MSA allows for advantageous visual and haptic properties, and good physical properties such as the tensile strength, the tear strength, the elongation at break or the grain extensibility of the thus-obtained leathers. Moreover, WO 2014/124951 A1 mentions that when using MSA in the fatliquoring step, if it is chrome-tanned leather, only minimal amounts of chromium compounds are washed out of the leather. However, WO 2014/124951 A1 does not disclose the use of MSA in the pickling step to increase the Cr(III) uptake and to decrease the Cr(III) content in the waste liquor, especially at a pH above or equal to 4.

SUMMARY OF THE INVENTION

Therefore, in one aspect, the present invention relates to a process for pickling hides or skins with MSA at a pH above or equal to 4.

In another aspect, the present invention relates to the use of MSA for improving the Cr uptake into the hides or skins during the pickling of hides or skins, and/or reducing the Cr content in the waste liquor from the processing (such as tanning, acid washing, retaining, dying and fatliquoring, especially tanning) of the hides or skins.

In another aspect, the present invention relates to the use of MSA in the pickling of hides or skins to improve the evenness of Cr distribution in the hides or skins during the Cr tanning.

In yet another aspect, the present invention relates to a leather product obtained by the process according to the present invention.

DETAILED DESCRIPTION OF THE INVENTION

Figure 1:
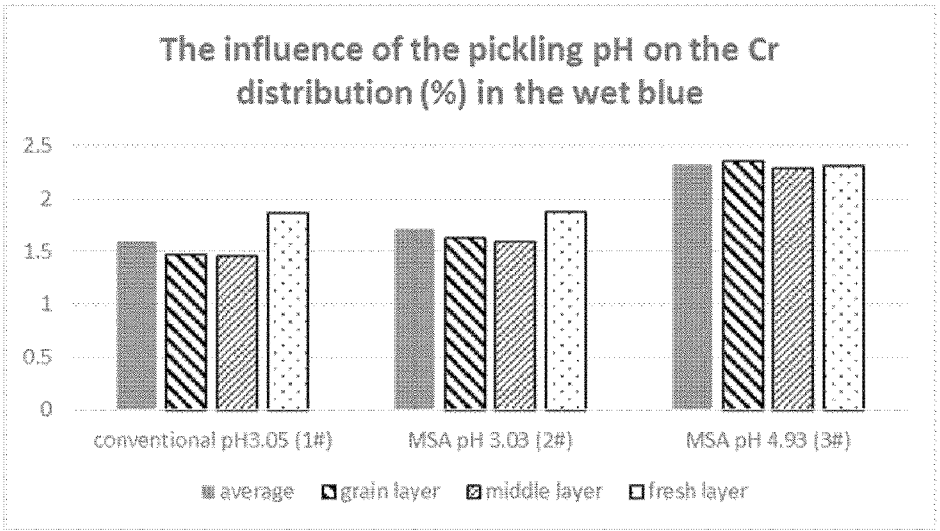
FIG. 1: The influence of the pickling pH on the Cr distribution (%) in the wet blue

The process of the present invention proceeds from animal hides or skins, or partly-processed hides or skins. Animal hides or skins can derive from any dead animals, for example from cattle, calves, pigs, goats, sheep, kangaroos, fish, ostriches or wild animals.

The process for producing leather generally comprises multiple steps. In the unhairing step, the majority of hair is removed from the animal hide or skin. In the subsequent fleshing step, flesh residues and subcutaneous adipose tissue are removed from the animal hide or skin, mechanically for example. In the subsequent liming step, unwanted proteins and an "opening up" structure is achieved. Frequently, sodium hydroxide, sodium carbonate, sulfides or organosulfur compounds are added during liming. In the subsequent deliming step, the liming and unhairing chemicals are removed from the hide or skin. In the subsequent bating step, the proteolytic proteins are introduced to the hide or skin to remove further proteins and to assist with softening of the hide or skin. After that, the step of pickling is carried out, usually with inorganic acids or organic acids and/or salts.

After the pickling, the tanning step is carried out in the presence of a tanning agent. The tanning agent used in the present invention is Cr (III) salts, optionally in combination with other tanning agents such as mineral salts (e.g., aluminum, zirconium or iron salts), vegetable tanning agents such as tannins derived from leaves, bark, woods or fruit, oil tanning agent such as fish or marine-animal oils (train oils) or brain fats, synthetic tanning agents such as syntans, resin type tanning agents, polymer type tanning agents, polyphosphates or paraffin sulfochloride, or aldehyde tanning agent such as formaldehyde or glutaraldehyde. Tanning is generally carried out at a lower pH than that of the pickling step due to the addition of the tanning agent, such as at a pH of 2-3.

Further operations usually include retanning, basification or neutralization, dyeing and fatliquoring. Retanning can in principle be carried out with any tanning materials which were described hereinbefore in connection with the tanning step. The basification (which is also referred to as deacidifying or neutralizing) step usually comprises neutralizing the residues of strong acids such as hydrochloric acid, sulfuric acid etc., which generally results in better stability for the leather.

Dyeing is normally carried out with dyes which form a chemical bond with the leather fiber. Fatliquoring imparts better softness and suppleness. Fatliquoring agents enclose the leather fibers with a thin film of fat. As a result, the fibers do not stick together as much during drying and can slide over each other more easily.

The abovementioned steps are frequently carried out in the stated order in the manufacturing operation. However, it is also possible for them to be carried out in different orders. In addition, processes for producing leather may also include further steps in addition to the aforementioned steps.

The further steps include for examples, wet-backing/washing, shaving/samming/splitting etc. The wet-backing/washing is generally carried out at a temperature of 30-40° C. for 20 min to few hours by using a wetting agent/emulsifier and weak acid, in order to get wet blue ready for later process. As to shaving/samming/splitting, these mechanical operations are mainly for the purpose of obtaining the right thickness for final leather. Samming is to get rid of the excess water in the leather and to be ready for splitting. Splitting is to get close thickness of the final leather, separate the grain and split, thus being ready for shaving. Shaving is to get as precise as possible thickness to the requirement of the final leather.

In the present invention, MSA is generally employed in the form of an aqueous solution.

MSA is a kind of organic strong acid. Both of its molecular mass and structure are similar to those of sulfuric acid. For there is an electron donor, i.e., methyl which connects directly with the sulfur atom, its pKa value (−0.6) is higher than that of sulfuric acid (pKa=−3.0), hydrochloric acid (pKa=−8.0), but lower than that of formic acid (pKa=3.77), acetic acid (pKa=4.76), thus the acidity of MSA is weaker than these common inorganic acids, but stronger than most of the organic acids.

It is surprising to find that by using MSA in pickling at a pH above or equal to 4 before tanning with Cr (III), the uptake of Cr (III) significantly increases and the Cr (III) content in the waste tanning liquor decreases. Moreover, it is surprising to find that by pickling with MSA, the Cr (III) ions are evenly distributed in the hides or skins, thus evenly-tanned leather is obtained, and the mechanical properties of the resulted leather are also improved.

Compared with the conventional pickling process which is generally carried out with mineral or organic acids at a pH of 2.0-3.0 (AD Covington, T Covington, 2009, "Tanning chemistry: the science of leather", Chapter 9, page 177, Royal Society of Chemistry), the present process is carried out at a higher pH which is above or equal to 4. If used herein, the term "high pH" means a pH value above the one used in the conventional pickling which is generally in the range from 2 to 3, in particularly, the pH used in the present invention is ≥4, preferably from about 4 to about 6, more preferably from about 4 to about 5.5. As used herein, the term "pickling pH" denotes to the pH of the hides or skins before the addition of chrome salts, which is also the end pH of pickling solution after the addition of all the pickling acids is completed and the resulted solution pH is stable, such as by stirring for 1-24 hours. Hereinafter, when referring to the pickling pH, it is always referred to the end pickling pH, unless otherwise specified.

In one embodiment, MSA could be employed together with inorganic salts. Suitable inorganic salts include, for example, salts of sulfuric acid, halohydric acids, phosphoric acid, boric acid, nitric acid. Examples of suitable inorganic salts include, for example, ammonium sulfate, sodium sulfate, sodium chloride, ammonium chloride.

In another embodiment, MSA could be employed together with salts of organic acids. Suitable salts of organic acids include, for example, ammonium, alkali metal or alkaline earth metal salts of organic acids such as ammonium, sodium, potassium or magnesium salts of organic acids. Suitable salts of organic acids include, for example, salts of monocarboxylic acids or dicarboxylic acids. Examples of suitable salts of organic acids are salts of formic acid, acetic acid, propionic acid, oxalic acid, malonic acid, succinic acid, glutaric acid, adipic acid, tartaric acid, lactic acid, phthalic acid, terephthalic acid, maleic acid, fumaric acid or MSA.

Although MSA could optionally be employed together with other acids as organic acids or inorganic acids, best results would be achieved if such other acids would be omitted in the process. Inorganic acids would include, for example, sulfuric acid, hydrochloric acid, boric acid, carbonic acid, or phosphoric acid. Organic acids would include, for example, monocarboxylic acids or dicarboxylic acids, such as formic acid, acetic acid, lactic acid, propionic acid, oxalic acid, malonic acid, succinic acid, glutaric acid, adipic acid, tartaric acid, lactic acid, phthalic acid, terephthalic acid, maleic acid or fumaric acid.

More particularly, it was found that in the present invention the presence of an organic acid or the salts thereof, especially formic acid or the salts thereof, would mask the Cr (III) ions, and thus could not contribute to decrease the Cr (III) content in the waste water. Therefore, in a preferred embodiment of the present invention, no other organic acid or the salts thereof, especially formic acid or the salts thereof is present in the pickling solution. Surprisingly, it is found that the Cr uptake of the hide or skin pickled with the solution of MSA without formic acid or the salts thereof is higher than that of the hide pickled with a solution comprising formic acid or the salts thereof, moreover, Cr is more evenly distributed in the leather and the mechanical properties would be enhanced.

When using in pickling at a pH equal or above 4, the amount of MSA would be significantly reduced and the associated work-up of the waste liquor would also be reduced, which would simplify and benefit the work-up process and thereby also reduce the cost significantly.

Therefore, in one embodiment of the present invention, MSA is generally used in an amount from about 0.1 to about 3.0 wt. % based on the weight of the limed hide to be pickled.

Preferably MSA is used in an amount from about 0.5 to about 2.5 wt. % based on the weight of the limed hide to be pickled.

And more preferably MSA is used in an amount from about 0.5 to about 1.5 wt. % based on the weight of the limed hide to be pickled.

MSA could be used alone or in the form of mixture with other ingredients which are familiar to the person skilled in the art, such as inorganic salts mentioned above. When used with other ingredients, it is possible to add firstly MSA alone, rotating for a while, then add the other ingredients (and the adding order is immaterial); or it is possible to add MSA and the other ingredients in different order or simultaneously.

The amounts of the other ingredients in the pickling solution are familiar to the person skilled in the art, and could be chosen according to the specific requirements of the operation.

The pickling according to the present invention is carried out at temperatures of from 10 to 30° C., preferably at from 20 to 25° C. A period from 10 minutes to 18 hours has been proven to be applicable, however a period ranging from 1 to 12 hours is preferred. The pickling process of the invention can be carried out in any desired type of vessels, for example in barrels or in rotated drums.

After pickling, the hide is tanned, retanned, basified, dyed and/or fatliquored or submitted to other process steps, which are generally known in the art.

Superior to the conventional processes, the present pickling process with MSA is conducted at a pH above or equal to 4 successfully and the total chromium utilization ratio is increased by, for example, from 81.0% to 95.8%. Accordingly, the total Cr dosage is decreased by 27% around, and the residual Cr concentration in the chrome-containing waste water is decreased by 44%-85%, varying according to the operations, and the total Cr discharge generated in the whole leather processing was reduced by 84% around. Moreover, the area yields, mechanical properties and organoleptic properties of the leather from the present process are superior to those from conventional processes.

Moreover, it was found that by using MSA in pickling, the fixation of Cr in the leather could be improved, which in turns makes Cr to be hard to exude from the tanned leather and discharge into the waste water during the subsequent steps. Therefore, the use of MSA in pickling could also reduce the Cr contents in the waste water from the steps subsequent to the tanning step, such as acid washing, retanning, dying or liquoring.

Therefore, in another aspect of the present invention, it is related to the use of MSA in the pickling of hides or skins to improve the Cr uptake into the hides or skins, and/or reduce the Cr content in the waste liquor from the processing of hides or skins. Moreover, it is related to the use of MSA in the pickling of hides or skins for further improving the evenness of Cr distribution in the hides or skins. Furthermore, it is related to the use according to the present invention for improving the mechanical strength of the resulted leather.

The invention is further explained by the following examples.

EXAMPLES

Abbreviations Used:

FA: formic acid

Na-FA: sodium formate

SA: sulfuric acid

MSA: methane sulfonic acid

Ts: shrinkage temperature

Chemicals Used:

Chromosal B® is a basic chrome sulfate used as Cr tanning agent and is available from Lanxess Co. Ltd.

Dowelltan MM51 is a condensate of formaldehyde and phenol sulfonic acids and is available from Dowell Science & Technology Inc.

Dowellan SWA is a mixture of alkoxylated long chain alcohols, which is used as wetting agent and is available from Dowell Science & Technology Inc.

Dowellan FG-B is a mixture of alkoxylated long chain alcohols, which is used as degreasing agent and is available from Dowell Science & Technology Inc.

Dowellzym BL is a mixture of pancreatic, other proteases and fillers, which is used as bating agent and is available from Dowell Science & Technology Inc.

Dowelltan NL20 is a mixture of phenol sulfonates and complexing agents, which is used as neutralizing agent and is available from Dowell Science & Technology Inc.

Dowellor PF is a kind of synthetic phosphate ester, which is used as fatliquoring agent and is available from Dowell Science & Technology Inc.

Dowellim DLA is a mixture of organic acid and inorganic acid salts without any ammonium, which is used as deliming agent and is available from Dowell Science & Technology Inc.

In the examples, the percentages refer to percentages by weight (wt. %), unless otherwise explicitly specified.

Measuring Method

The shrinkage temperature (Ts) was measured according to QB/T2713-2005. Alternatively, test method ISO 3380: 2002 can be used for measuring the shrinkage temperature.

The tensile strength and elongation at break were measure according to QB/T2710-2005.

Alternatively, test method ISO 3376:2011 (IULTCS/IUP 6) can be used for measuring the tensile strength and elongation at break.

The tear strength is measure according to QB/T2711-2005. Alternatively, test method ISO 3377-2:2016 (IULTCS/IUP 8) can be used for measuring the tear strength.

The Cr content is measured according to QB/T1275-2012. Alternatively, ISO5398-2007 can be used for measuring the Cr content.

Unless specified otherwise, all the test methods used in the following examples refer to the QB/T methods, which are adoptions from ISO, IEC or other international standards developers. The GB Standards can be looked up at the Standardization Administration of the People's Republic of China, the SAC (http://www.sac.gov.cn/SACSearch/outline-templet/gjbzcx.jsp), which lists all mandatory and voluntary national standards.

The ISO standards are mentioned for illustrating applicable international measurement methods in addition.

The area per weight (also known as yield) refers to the percentage of the area of the obtained leather relative to the raw hide, and could be calculated by dividing the surface area of the leather by the surface area of the raw hide.

Example 1—the Use of MSA on the Uptake of Cr and the Distribution of Cr in the Hides In order to study the pickling pH on the uptake and distribution of Cr during the Cr tanning, an experiment was carried out in which cattle hides were pickled at different pH and then tanned.

A limed hide was weighted and the weight thereof was used as basis for calculating the percentage of chemicals and active agents to be used in the process, as shown in tables below. After the step of liming, the hide was subjected to pickling with different pickling solutions, which comprises water and NaCl, and the pickling acid(s) of No. 1 #, 2 # and 3 # (see table 2). In general, the components of the pickling solutions 1 #, 2 # and 3 # used in the individual tables, differ depending on the example, so the term "1 #", "2 #" and "3 #" refer to the specific respective examples, in which the pickling solution is used and for which it is described.

The specific procedure was as following: adding all the components of the pickling solution, rotating for 30 min, then stopping the drum and standing overnight. After that, the pickled hide was subjected to Cr tanning, basification, shaving, wet-backing, water washing, retanning, and basification again.

The specific operations are shown in the following Table 1.

TABLE 1

The procedure of the experiment

| Operations | Chemicals | Amounts (wt %) | Specification | Comments |
|---|---|---|---|---|
| Liming | | | Weighing and using the weight as the basis for the chemicals | |
| Deliming | | | | |
| Bating | | | | |
| Pickling | Water | 50 | 22° C. | |
| | NaCl | 6 | | |
| 1# | FA | 0.5 | | |
| | SA | 1.0 | Rotating for 30 min | Stopping the drum, and standing overnight |

TABLE 1-continued

The procedure of the experiment

| Operations | Chemicals | Amounts (wt %) | Specification | Comments |
|---|---|---|---|---|
| 2#resp. 3# | MSA | X* | Rotating for 30 min | Stopping the drum, and standing overnight |
| Next day | | | | |
| Cr tanning | | | | |
| | Chromosal B | 5.0 | Rotating for 180 min | |
| Basification | $NaHCO_3$ | | To control the end pH to be 4.0-4.2 | |
| Adding water | | | To control the total liquor ratio to be 2.0 | Keeping under 40° C. for 120 min |
| Next day | | | Rotating for 30 min, measuring pH | |
| Adjusting pH | | | To control the pH to be 4.0-4.1 | Taking out of the drum |
| wringing | | | | |
| Shaving | | | The thickness is about 1.3-1.4 mm | Marking and weighing, and the weight is used as the basis for other chemicals |
| Wet-backing | water | 300 | 40° C. | |
| | Dowellan SWA | 0.3 | | |
| | Dowellan FG-B | 0.3 | 30 min | Measuring the pH |
| | $NaHCO_3$ | 0.3 | 90 min, to control the pH to about 4.5 | |
| Water washing | water | 200 | 20 min | Sampling the hide and measuring the Cr content and Ts |
| Acid washing | water | 150 | 40° C. | |
| 1# | FA | | 90 min | pH 3.5-3.7 |
| 2#, resp.3# | MSA | | 90 min | pH 3.5-3.7; measuring the Cr content in the waste liquor |
| retanning | Chromosal B | 4.0 | Rotating for 90 min | |
| Basification | $NaHCO_3$ | | Adding in portions with each portion being 0.2 wt. % at an interval of 20 min | To control the end pH to 4.5 |
| Rotating | | | 30 min, overnight | |
| Next day | | | Rotating for 30 min, measuring pH | To control the pH to be about 4.2 |
| draining | | | | Measuring Cr contents in the waste liquor and the hides |
| Water washing | Water | 200 | 20 min | |

*The amount of MSA can be found in Table 2.

The results are shown in Table 2.

TABLE 2

The influence of the pickling pH on the effects of Cr tanning

| Operation | | Conventional, without MSA (1#) | MSA* (2#) | MSA** (3#) |
|---|---|---|---|---|
| Tanning | Amount of the acid (wt. %) | FA0.5 + SA1.0 | 2.3 | 1.2 |
| | Amount of Chromosal B (wt. %) | 5.0 | 5.0 | 5.0 |
| | Pickling pH | 3.05 | 3.03 | 4.93 |
| | pH after basification | 4.06 | 4.16 | 4.15 |
| | The pH when taking out of the drum | 4.03 | 4.05 | 4.09 |
| | Ts (° C.) | 114 | 110.6 | 115.3 |
| | Cr content in the waste liquor (mg/L) | 1640.25 | 925.25 | 340.8 |

TABLE 2-continued

The influence of the pickling pH on the effects of Cr tanning

| Operation | | Conventional, without MSA (1#) | MSA* (2#) | MSA** (3#) |
|---|---|---|---|---|
| Retanning | Acid washing pH | 3.44 | 3.36 | 3.38 |
| | Amount of Chromosal B wt. % | 4.0 | 4.0 | 4.0 |
| | pH after basification | 4.22 | 4.24 | 4.25 |
| | Ts (° C.) | 127 | 120 | 129 |
| | Cr content in the waste liquor (mg/L) | 495 | 252 | 163 |
| | Cr content in the wet-blue (wt. %) | 3.26 | 3.52 | 3.90 |

*Comparative example with MSA at pH below 4 (not according to the present invention.)
**Inventive example with MSA at pH above 4 (according to the present invention.)

As can be seen from Table 2, compared with the conventional pickling by using FA and SA, when using at the similar pH (3.05 and 3.03, respectively), the Cr content in the waste liquor could be reduced by about 50 wt. % by using MSA; and when the pickling pHs were controlled to be above pH4, the Cr contents in the waste liquors were decreased by above 70 wt. %.

Moreover, compared with pickling with MSA at a lower pH (3.03), when pickling at a higher pH (4.93), the Cr contents in the tanning waste liquors were surprisingly further decreased by more than 50 wt. %.

Moreover, when the pickling pH was about 5.0, the Ts was higher, which means that in this case, the penetration of Cr was not negatively affected, instead, the effective crosslinking degree in the wet blue was increased.

After the retanning, the Ts of the wet blue was further increased and the Cr content in the waste liquor was reduced by above 50%. Moreover, the Cr contents in the wet-blue were greatly increased by using MSA pickling. This proves that the use of MSA could improve the Cr uptake of the hide.

In order to further study the Cr distribution in the wet blues, the wet blues obtained according to Table 1 were freeze dried and cut into three layers in the direction of thickness by a layer-splitting machine, then cut into pieces, after the weight was constant, the pieces were dissolved in a mixture of nitric acid and hydrochloric acid in a volume ratio of 1:3 at the temperature of 120° C., then diluted after cooling. The Cr content was measured by ICP-AES (Inductively Coupled Plasma Atomic Emission Spectrometry). For each sample, three measurements were repeated and the results were averaged. The results are shown in Table 3 and FIG. 1.

TABLE 3

The influence of the pickling pH on the Cr distribution (%) in the wet blue

| | average | grain layer | middle layer | flesh layer |
|---|---|---|---|---|
| conventional pH 3.05 (1#) | 1.60 | 1.46 | 1.45 | 1.87 |
| MSA pH 3.03 (2#) | 1.71 | 1.63 | 1.60 | 1.88 |
| MSA pH 4.93 (3#) | 2.32 | 2.36 | 2.29 | 2.31 |

As can be seen from Table 3 and FIG. 1, compared with the conventional pickling process, at the similar pHs, the Cr contents in each layers from the MSA pickling were relatively higher, which means that the use of MSA could improve the Cr uptake of the hide; and when the pH of the MSA pickling was controlled to be above 4, the Cr contents in each layers were significantly increased. This means that controlling of the pH of the MSA pickling to be above 4 does not hinder the penetration of Cr, instead, it could greatly facilitate the penetration of Cr. Thus, MSA pickling at a pH of 4 or above is feasible and advantageous.

Example 2—the Comparison Between the Effects of the MSA Pickling at a pH Above 4 and Those of the Conventional Pickling A limed cattle skin was cut along the backbone line, marked and weighed, the weight being used as the basis for calculating other chemicals to be used in the subsequent process steps. Then, the limed skin was subjected to the steps of deliming, bating and pickling in a MSA process, or, alternatively, in a conventional process without using MSA. After the pickling step, the subsequent process steps of Cr tanning, basification, shaving and wet backing were conducted. The conditions of the specific process operations can be found in Table 4. The Cr uptake, Cr distribution, Cr exudation after tanning, and the overall properties of the obtained leathers were measured.

TABLE 4

The MSA process and the conventional process

| Operations | Chemicals | Amount (wt. %) | Specification | Comments |
|---|---|---|---|---|
| Limed skin | | | cutting along the backbone line | Thickness about 2.2 mm |
| Weighing | | | Marking, and using as the basis for the other chemicals | |
| Water washing | water | 200 | 30 min, twice | |
| Deliming | water | 30 | 33° C. | |
| | ammonium sulfate | 3.0 | 90 min, draining | |
| Water washing | water | 200 | 30 min | |
| Bating | water | 100 | 35° C. | |
| | Dowellzym BL | 0.5 | 60 min, checking the bating condition, draining | |
| Water washing | water | 200 | 30 min, twice | |
| Pickling | water | 50 | | |
| | NaCl | 7 | 10 min | |
| 1# | FA | 0.5 | 30 min | |
| | SA | 1.1 | 180 min, pH 2.74, overnight | |
| 2# | FA | 0.1 | 30 min | |
| | MSA | 1.0 | 180 min, pH 4.86, overnight | |
| Next day | | | | |
| Cr tanning | | | | |
| 1# | Chromosal B | 6.5 | Rotating for 180 min, checking the penetration | Comparing the penetrating speed and measuring Ts |
| 2# | Chromosal B | 4.5 | Rotating for 180 min, checking the penetration | |

TABLE 4-continued

| The MSA process and the conventional process | | | | |
|---|---|---|---|---|
| Operations | Chemicals | Amount (wt. %) | Specification | Comments |
| Basification | $NaHCO_3$ | | Adding in portions at an interval of 30 min for each portion, the end pH is 4.0-4.2 | |
| Adding water | water | | 60° C., the total liquor ratio is 2.0, keeping at the constant temperature for 120 min | |
| Adjusting pH | | | Adjusting pH to 4.0-4.2, rotating for 30 min, overnigh | |
| Next day | | | Rotating for 30 min, checking pH, taking out of the drum | Measuring the Cr content, Ts, Cr distribution and SEM |
| Allowing to stand | | | Horsing up for 24 hr | |
| Wringing | | | | |
| Shaving | | | Thickness about 1.2 mm | |
| weighing | | | | |
| Wet-backing | water | 200 | 40° C. | |
| | Dowellan SWA | 0.2 | | |
| | Dowellan FG-B | 0.3 | | |
| | $NaHCO_3$ | | 90 min, controlling pH to about 4.5 | Measuring the Cr content in the waste liquor |
| Draining | | | | |

The results are shown in Table 5.

TABLE 5

| The comparison of the Cr tanning effects between the MSA pickling at a pH above 4 and the conventional pickling | | | | | | |
|---|---|---|---|---|---|---|
| Pickling process | Pickling pH | Acid amount (wt. %) | Amount of Chromosal B (wt. %) | Area per weight* ($ft^2$/kg) | Ts (° C.) | Cr content in the waste liquor (mg/L) |
| Conventional process (1#) | 2.74 | FA 0.5 + SA1.1 | 6.5 | 3.10 | 110 ± 1.5 | 864 ± 2.4 |
| MSA process (2#) | 4.86 | FA 0.1 + MSA0.9 | 4.5 | 3.10 | 107 ± 2.0 | 167 ± 3.3 |

*the surface area of the wet blue that every kilogram of hides corresponds to.

As could be seen from Table 5, compared with the conventional pickling process, the area of the wet blue after the MSA pickling remained unchanged, which means that when MSA pickling was carried out at a pH above 4, the hide would not shrink and the leather area would not be affected. In the MSA pickling with a pH above 4, when the amount of Cr used in the tanning was reduced by about 31 wt. % compared with the conventional pickling process (4.5 wt. % vs. 6.5 wt. %), the shrinkage temperature and the area per weight of the obtained wet blue obtained from the MSA pickling were similar to those obtained from the conventional pickling process, moreover, the Cr content in the waste liquor was reduced by about 80 wt. %. This proves that by pickling with MSA, the amount of Cr tanning agent could be reduced, and thus the burden to the environment is greatly reduced, at the same time the Cr content in the waste water could be reduced, while leather with a similar Ts and area per weight could be achieved.

The crust leather obtained from the procedures shown in Table 4 was vacuum dried, moisture regained, oscillated and milled, and the mechanical properties were measured according to the standard methods shown in the above. The results are shown in Table 6.

TABLE 6

The mechanical properties of the crust leather

| Process | Ts (° C.) | Area per weight ($ft^2$/kg) | tensile strength ($N/mm^2$) | tear strength (N/mm) | elongation at break (%) |
|---|---|---|---|---|---|
| Conventional process (1#) | 121.6 ± 2.2 | 7.54 | 7.53 ± 1.15 | 25.58 ± 5.67 | 45.66 ± 4.68 |
| MSA process (2#) | 121.1 ± 2.3 | 7.52 | 7.86 ± 0.89 | 32.02 ± 3.42 | 56.74 ± 3.22 |

As could be seen from Table 6, after Cr retanning, the Ts of the wet blue was substantially the same; moreover, the areas per weight of the crust leathers obtained by these two processes were substantially unchanged. Both of these mean that the use of MSA in the pickling would not cause the shrinkage of the crust leather. More importantly, the tensile strength, the tear strength and the elongation at break of the crust leathers obtained by the MSA process were improved compared with the conventional one.

Figure 2:
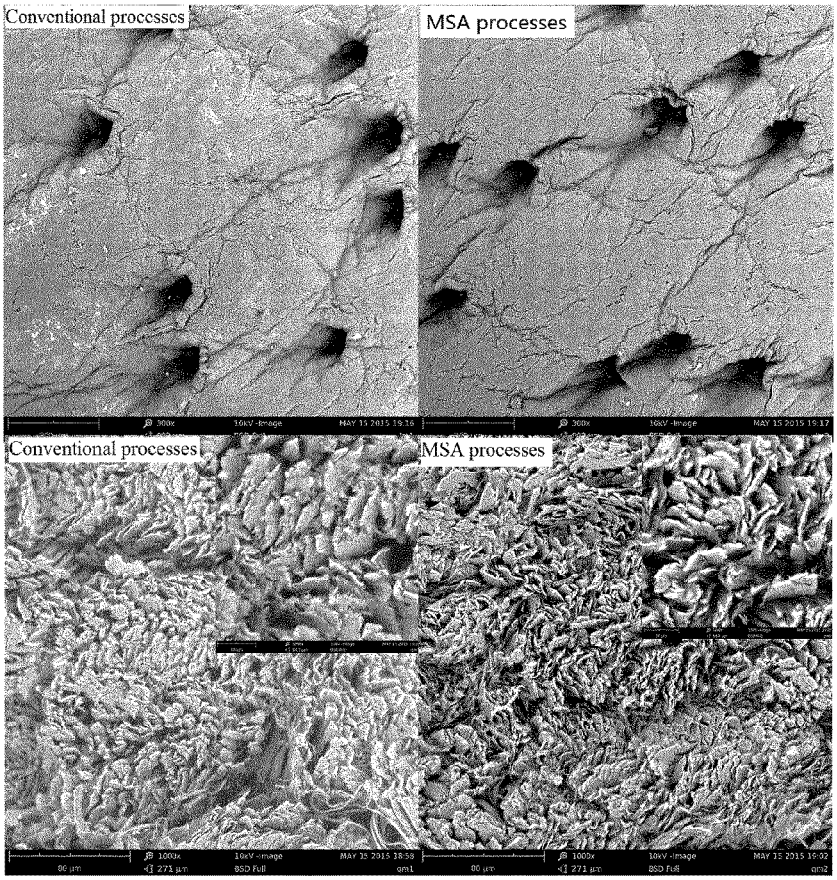
FIG. 2: The SEM photographs of the grain of the crust leather (x300, top) and the cut (x1000, x5000, respectively, bottom)

The grain and the fibers distribution in the cut were observed by a Scanning Electronic Microscopy (SEM), the result is shown in FIG. 2.

As could be seen from FIG. 2, compared with the conventional process, the grain obtained from the MSA pickling at a pH above 4 was more even and finer, and the fibers in the cut are more loose.

Example 3

The experiment was carried out on cow hides used for sofa leather. In this example, the Cr contents in the waste liquors from certain main procedures during the processing of the hide were studied.

A limed hide with a thickness of about 2.6 mm was marked and weighted, and the weight was used as the basis for calculating the ratio of the other chemicals. The limed hide was subjected to the steps of deliming, bating, pickling, Cr tanning, basification, shaving, wet-backing, Cr-retanning, basification once more, retanning and filling, and fatliquoring. The specific operations are shown in Table 7.

TABLE 7

| Operations | Chemicals | Amounts (wt. %) | Specification | Comments |
|---|---|---|---|---|
| Limed hide | | | Thickness about 2.6 mm | Marking and weighing, and using as the basis for the other chemicals |
| Water washing | water | 200 | 20 min × 2 | |
| Deliming | water | 30 | 33° C. | |
| | Dowellim DLA | 2 | 90 min | |
| Water washing | water | 200 | 30 min | |
| Bating | water | 100 | 33° C. | |
| Water washing | water | 200 | 20 min × 2 | |
| pickling | water | 50 | | |
| | NaCl | 6 | Rotating for 10 min | |
| 1# | FA | 0.5 | Rotating for 30 min | |
| | SA | 0.8 | Rotating for 210 min; standing overnight | |
| 2# | FA | 0.15 | Rotating for 30 min | |
| | MSA | 0.7 | Rotating for 210 min; standing overnight | |
| 3# | MSA | 1.0 | Rotating for 210 min; standing overnight | |
| Next day | | | Rotating for 30 min, checking pH | |
| Cr tanning | | | | |
| 1# | Chromosal B | 5.0 | | |
| | Na-FA | 1.0 | Rotating for 180 min | |
| 2# | Chromosal B | 4.0 | Rotating for 180 min | |
| 3# | Chromosal B | 4.5 | Rotating for 180 min | |
| Basification | $NaHCO_3$ | To control pH at about 4.2 | Adding in portions at an interval of 30 min, with each portion being 0.2% | |
| Adding water | | | To control the total liquor ratio to be 2.0; keeping constant at 40° C. | 120 min |
| Adjusting pH | $NaHCO_3$ | | Adding in portions at an interval of 30 min, with each portion being 0.1% | To control pH at 4.0, standing overnight |
| Next day | | | Rotating for 30 min, checking pH | |

TABLE 7-continued

| Operations | Chemicals | Amounts (wt. %) | Specification | Comments |
|---|---|---|---|---|
| Taking out of the drum | | | | Measuring the Cr content in the waste liquor (0) and the wet blue, and Ts |
| | | | Standing for 24 hours | |
| Shaving | | | | Thickness about 1.2-1.3 mm |
| Wet-backing | water | 300 | 40° C. | |
| | Dowellan SWA | 0.3 | | |
| | Dowellan FG-B | 0.3 | 30 min | Measuring the pH |
| | $NaHCO_3$ | 0.3 | 90 min, to control the pH to about 4.5 | |
| Cr-retanning | Chromosal B | 4 | | |
| 1# | Na-FA | 0.8 | | |
| 2# | Na-FA | 0.1 | | |
| Basification | $NaHCO_3$ | | Adding in portion with each portion being 0.2% at an interval of 30 min, pH4.2, overnight | |
| Overnight | | | | |
| Next day | | | | |
| Water washing | water | 200 | 20 min | Measuring the Cr content in the waste liquor (3) |
| Neutralization | water | 150 | 40° C. | Measuring the Cr content in the waste liquor (4) |
| Retanning | Chromosal B | 4.0 | | |
| Filling | water | 100 | 40° C. | |
| | aldehyde tanning agent | 1.5 | 60 min | |
| | Electrolyte-resistance oil | 2 | 30 min; measuring pH | |
| | Acrylic acid retanning agent | 2 | 40 min; measuring pH | |
| | Syntan | 8 | 40 min; measuring pH | |
| | filler | 10 | 60 min; measuring pH | Measuring the Cr content in the waste liquor |
| | acid | | 30 min; to control pH about 4.5 | Measuring the Cr content in the waste liquor |
| Dying | water | 150 | 55° C. | |
| | acid blue | 3 | 30 min | |
| Fatliquoring | Dowellor PF | 12 | Rotating for 90 min | |

The Cr contents in the waste liquors from various operations were studied, and the results are shown in Table 8.

TABLE 8

| The Cr contents in the waste liquors from various operations ($mg \cdot L^{-1}$) | | | |
|---|---|---|---|
| operations | Conventional pickling (1#) | MSA + FA, higher pH (2#) | MSA, higher pH (3#) |
| Pickling pH | 3.10 | 5.07 | 5.00 |
| Tanning | 802 | 224 | 155 |
| Acid washing | 67 | 8 | 9 |
| Cr retanning | 630 | 440 | 50 |
| Retanning and filling | 25 | 8 | 6 |
| Dying and Fatliquoring | 33 | 2 | 2 |

As could be seen from Table 8, compared with the convention pickling, the MSA pickling could significantly reduce the Cr content in the waste liquor from the tanning step. Moreover, by comparing 2# with 3#, the Cr contents in the waste liquors obtained by pickling with MSA and FA were higher than those in the waste liquors obtained by pickling with MSA only. This proves that the use of FA could decrease the uptake of Cr and thus increase the Cr content in the waste liquor. Furthermore, compared with the conventional process, by pickling with MSA or MSA and FA, respectively, the Cr contents in the waste liquors from the steps subsequent to the tanning were also significantly decreased; this proves that the use of MSA could also improve the fixation and decrease the Cr exudation of the wet blue during the subsequent steps.

Figure 3:
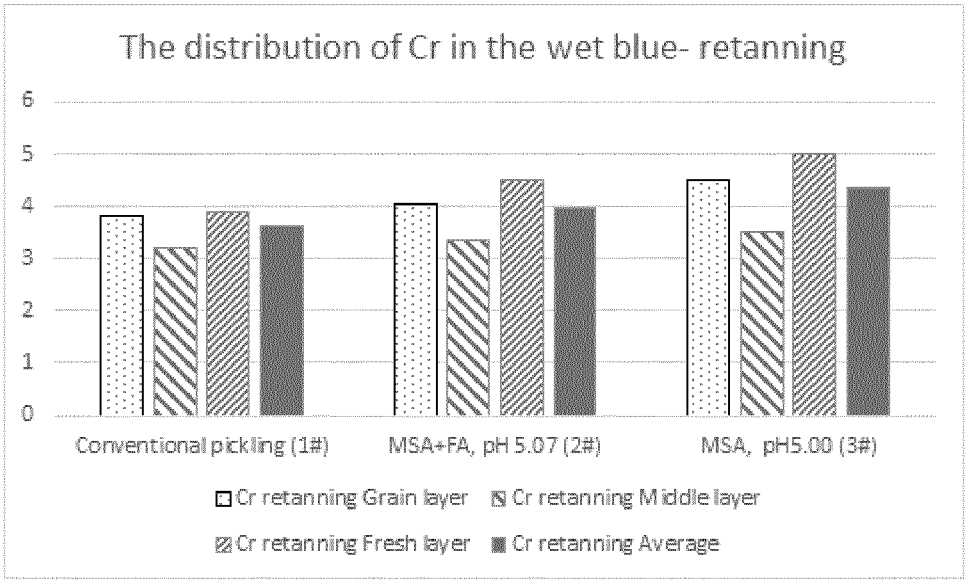
FIG. 3: The distribution of Cr in the wet blue retanning

Moreover, the Cr distribution in the wet blue was studied according to the procedure in Example 1, and the results are shown in Table 9 and FIG. 3.

TABLE 9

| The distribution of Cr in the wet blue | | | | |
|---|---|---|---|---|
| | | Conventional pickling, pH 3.10 (1#) | MSA + FA, pH 5.07 (2#) | MSA, pH 5.00 (3#) |
| Cr retanning | Grain layer | 3.8 | 4.04 | 4.51 |
| | Middle layer | 3.22 | 3.35 | 3.50 |
| | Flesh layer | 3.91 | 4.5 | 5.02 |
| | Average | 3.63 | 3.97 | 4.34 |

As could be seen from Table 9 and FIG. 3, by pickling with MSA at a pH above 4, the evenness of the distribution of Cr in the hide was not decreased. In contrary, during the Cr tanning, when the amount of Chromosal B was decreased from 5.0 wt. % (conventional pickling, 1#) to 4.5 wt. % (MSA, pH above 4, 3#), the Cr content and distribution in the wet blues were even better. This proves that the use of MSA could reduce the amount of Cr tanning agent, but increase the uptake of Cr and thus achieve a superior tanning result.

After the Cr retanning, the Cr contents in the wet blues pickled with MSA (2# and 3#) were higher than those in the wet blues pickled by the Conventional process (1#).

In summary, the present process for pickling with MSA could increase of the uptake of Cr (III) during the chrome tanning and decrease of the Cr (III) content in the waste tanning liquor, moreover, it would result in evenly tanned leather. Furthermore, the area yields, mechanical properties and organoleptic properties of the leather are superior to those obtained from the conventional processes.

The invention claimed is:

1. A process for producing leather, comprising pickling a limed hide or skin with a pickling solution comprising 1-2.5% methanesulfonic acid (MSA), wherein the pickling solution has an end pH value after addition of MSA and before addition of a Cr(III) tanning agent, wherein the end pH value is above 4 and up to 6;

tanning the pickled hide or skin with a Cr(III) tanning agent, wherein upon Chrome tanning with the Cr(III) tanning agent, the leather has an increased Cr content and/or reduced Cr contents in waste water compared to Chrome tanning a limed hide or skin obtained by pickling at a pH of less than 4.

2. The process according to claim 1, wherein the end pH value is above 4 and up to 5.5.

3. The process according to claim 1, wherein no further organic or inorganic acid, or the salts thereof, are present in the pickling solution.

4. The process according to claim 1, wherein the pickling solution is free of sulfuric acid, hydrochloric acid, boric acid, carbonic acid, phosphoric acid, monocarboxylic acids or dicarboxylic acids, formic acid, acetic acid, lactic acid, formic acid, propionic acid, oxalic acid, malonic acid, succinic acid, glutaric acid, adipic acid, tartaric acid, lactic acid, phthalic acid, terephthalic acid, maleic acid or fumaric acid, or the salts thereof.

5. The process according to claim 1, wherein no formic acid or the salts thereof are used in the pickling solution.

6. The method according to claim 1, wherein the pickling improves evenness of Cr distribution in the hides or skins during the Cr tanning.

7. The method according to claim 1, wherein the pickling enhances fixation of Cr in Cr tanned leather.

8. The method according to claim 1, further comprising improving mechanical strength of the resulted leather with MSA.

9. A leather pickling solution of end pH value above 4 and up to 6, comprising 1-2.5% MSA, wherein the pickling solution is suitable for a leather tanning process.

* * * * *